US006006523A

United States Patent [19]

Mandai et al.

[11] Patent Number: 6,006,523

[45] Date of Patent: Dec. 28, 1999

[54] GAS TURBINE COMBUSTOR WITH ANGLED TUBE SECTION

[75] Inventors: Shigemi Mandai; Nobuo Sato; Satoshi Tanimura; Hitoshi Kawabata, all of Hyogo-ken, Japan

[73] Assignee: Mitsubishi Heavy Industries, Ltd., Tokyo, Japan

[21] Appl. No.: 08/846,644

[22] Filed: Apr. 30, 1997

[51] Int. Cl.[6] ..... F23R 3/42

[52] U.S. Cl. ..... 60/722; 60/752

[58] Field of Search ..... 60/39.37, 722, 60/752, 39.32

[56] References Cited

U.S. PATENT DOCUMENTS 2,529,946 11/1950 Imbert ..... 60/752

2,592,060 4/1952 Oulianoff ..... 60/39.37

2,853,227 9/1958 Beardsley ..... 60/39.37

3,759,038 9/1973 Scalzo et al. ..... 60/39.32

*Primary Examiner*—Louis J. Casaregola

*Attorney, Agent, or Firm*—Alston & Bird LLP

[57] ABSTRACT

A combustor inner tube 102 or a burner 101 provided on the upstream side of a tail pipe 103 having a straight or substantially straight axis is disposed at an angle with respect to the axis of tail pipe 103, by which a secondary flow is produced in combustion gas. Thereby, low-temperature gas at the outer peripheral portion is mixed with high-temperature gas at the central portion so that the gas temperature distribution is made uniform.

1 Claim, 1 Drawing Sheet

GAS TURBINE COMBUSTOR WITH ANGLED TUBE SECTION

FIELD OF THE INVENTION AND RELATED ART STATEMENT

The present invention relates to a gas turbine having an improved combustion portion.

FIG. 3 shows combustion inner tube and tail pipe portions of a conventional gas turbine. Fuel and air are supplied from a burner 301 into the combustor inner tube 302 and burned there. The combustion gas passes through the tail pipe 303 and is supplied to a turbine (not shown) from a tail pipe outlet 304. The arrow marks in the figure indicate the flow of combustion gas.

In a high-temperature gas turbine, the temperature distribution at the turbine inlet portion must be brought close to the design value to the utmost to prolong the turbine life. On the other hand, the dilution air for adjusting the temperature distribution at the combustor outlet, that is, the temperature distribution at the turbine inlet decreases because a higher temperature of combustor increases the combustion air ratio and the wall surface cooling air ratio. In the conventional gas turbine, therefore, the temperature distribution at the combustor outlet becomes bad, so that it is vert difficult to form a gas temperature distribution which is desirable for the turbine.

OBJECT AND SUMMARY OF THE INVENTION

An object of the present invention is to provide a gas turbine which can solve the above problem.

That is to say, an object of the present invention is to provide a gas turbine in which the temperature of gas supplied to the gas turbine can be made uniform, and a gas having a desirable temperature distribution can be supplied to the turbine.

To achieve the above object, in a gas turbine in accordance with the present invention, a combustor inner tube or a burner provided on the upstream side of a tail pipe having a straight or substantially straight axis is disposed at an angle with respect to the axis of tail pipe so that combustion gas collides with the back side of tail pipe.

The gas turbine configured as described above achieves the following effect: Since the combustor inner tube or the burner is disposed at an angle with respect to the axis of tail pipe, the combustion gas leaving the combustor inner tube collides with the back side of the tail pipe, so that the pressure in this region increases. At the same time, a region having a low flow velocity and low pressure is formed on the belly side of the tail pipe. The pressure difference between these regions produces a secondary flow in the cross section of the tail pipe, by which low-temperature gas at the outer peripheral portion in the tail pipe is mixed with high-temperature gas at the central portion so that the gas temperature distribution is made uniform.

Also, in the preferred embodiment of the present invention, the angle is set at 3 to 5 degrees.

DETAILED DESCRIPTION OF PREFERRED EMBODIMENTS

Figure 1:
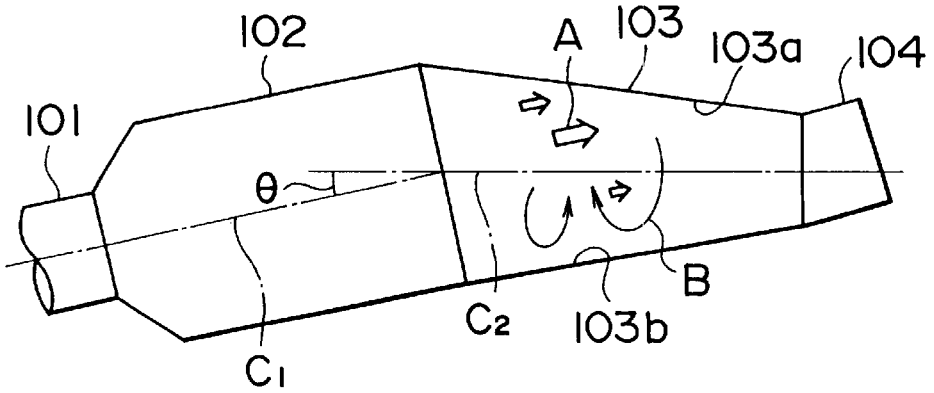
FIG. 1 is a view showing a configuration of a burner, combustor inner tube, and tail pipe for a gas turbine in accordance with a first embodiment of the present invention.

A first embodiment of the present invention will be described with reference to FIG. 1. Reference numeral 103 denotes a conical tail pipe which has a cross section decreasing gradually on the downstream side and has a straight axis. To the upstream side of the tail pipe 103, a cylindrical combustor inner tube 102 having a burner 101 is connected. The burner 101 is provided at the upstream end of the combustor inner tube 102. The burner 101 and the combustor inner tube 102 are arranged coaxially, and the axis $C_1$ of the combustor inner tube 102 makes an angle θ with respect to the axis $C_2$ of the tail pipe 103. The angle θ should preferably be 3 to 5 degrees.

In this embodiment, the fuel supplied from the burner 101 is burned in the combustor inner tube 102, and the combustion gas passes through the tail pipe, being supplied to a turbine (not shown) from a tail pipe outlet portion 104. Since the axis $C_1$ of the combustor inner tube 102 makes an angle θ with respect to the axis $C_2$ of the tail pipe 103, the combustion gas leaving the combustor inner tube 102 collides with the back-side portion 103*a* of the tail pipe as indicated by arrow A, so that the pressure in this region increases. At the same time, a region having a low flow velocity and low pressure is formed on the belly side 103*b* of the tail pipe 103. The pressure difference between these regions produces a secondary flow in the cross section of the tail pipe 103 as indicated by arrow B, by which low-temperature gas at the outer peripheral portion in the tail pipe 103 is mixed with high-temperature gas at the central portion so that the gas temperature distribution is made uniform. The gas whose temperature distribution is made uniform is supplied to the turbine.

Figure 2:
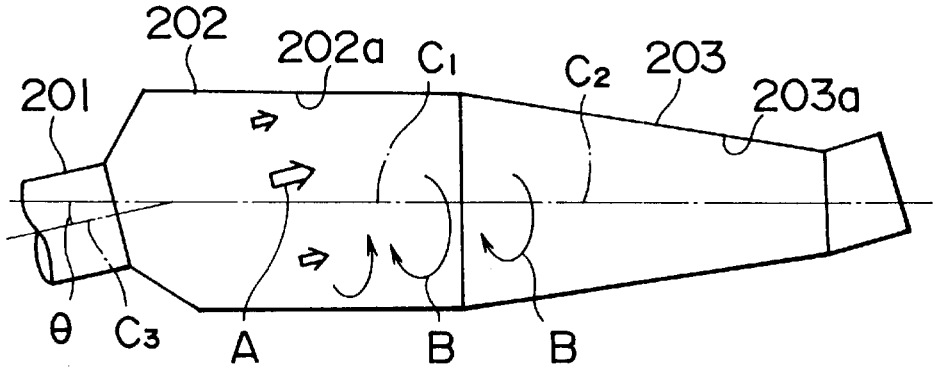
FIG. 2 is a view showing a configuration of a burner, combustor inner tube, and tail pipe for a gas turbine in accordance with a second embodiment of the present invention.
Figure 3:
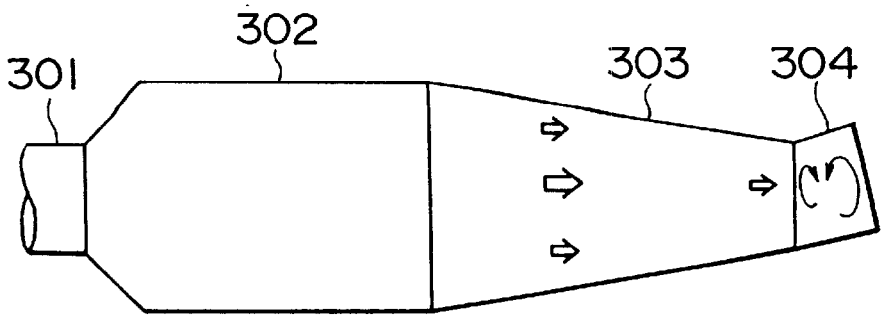
FIG. 3 RELATED ART
FIG. 3 is a view showing a configuration of a combustor inner tube and tail pipe for a conventional gas turbine.

Next, a second embodiment of the present invention will be described with reference to FIG. 2. A conical tail pipe 203 which has a cross section decreasing gradually on the downstream side and has a straight axis $C_2$ and a cylindrical combustor inner tube 202 connected to the upstream side of the tail pipe 203 are arranged coaxially. The axis $C_3$ of a burner 201 provided at the upstream end of the combustor inner tube 202 makes an angle θ with respect to the axes $C_1$ and $C_2$ of the combustor inner tube 202 and the tail pipe 203, respectively. The angle θ should preferably be 3 to 5 degrees.

In this embodiment, since the axis $C_3$ of a burner 201 makes an angle θ with respect to the axes $C_1$ and $C_2$ of the combustor inner tube 202 and the tail pipe 203, respectively, the combustion gas generated in the combustor inner tube 202 by the fuel and air supplied from the burner 201 flows as indicated by arrow A and collides with the back-side portions 202*a* and 203*a* of the combustor inner tube 202 and the tail pipe 203, respectively. In this embodiment, therefore, for the same reason as that in the first embodiment, a secondary flow as indicated by arrow B is produced, by which low-temperature gas at the outer peripheral portion is mixed with high-temperature gas at the central portion so that the gas temperature distribution is made uniform. This gas having a uniform temperature distribution can be supplied to the turbine.

Although the axes $C_1$ and $C_2$ of the combustor inner tube 202 and the tail pipe 203 are coaxial in this embodiment, the combustor inner tube 202 and the tail pipe 203 can be arranged so that the axis $C_1$ makes an angle with respect to the axis $C_2$.

As described above, according to the present invention, the combustor inner tube or burner provided on the upstream side of the tail pipe having a straight or substantially straight axis is disposed at an angle with respect to the axis $C_2$ of the tail pipe, by which the secondary flow is produced in the combustion gas. Thereupon, the low-temperature gas at the outer peripheral portion is mixed with the high-temperature gas at the central portion so that the gas temperature distribution is made uniform.

Thus, according to the present invention, the low-temperature gas at the outer peripheral portion is mixed with the high-temperature gas at the central portion by the secondary flow formed in the tail pipe or in the tail pipe and combustor inner tube. Thereby, the gas temperature distribution in the cross section of the tail pipe is made uniform. The highest gas temperature is decreased, and the lowest gas temperature is increased, so that the gas having a desirable temperature distribution can be supplied to the turbine.

According to the present invention, by improving the flow of combustion gas in the combustor inner tube or the tail pipe, the secondary flow is produced in the combustion gas flow having a temperature distribution. The combustion gas is mixed by this secondary flow, whereby the temperature distribution of combustion gas can be made uniform.

We claim:

1. A gas turbine, comprising:

a conical tail pipe for transport of combustion gases, said tail pipe having an axis, an outlet, and an inner wall, wherein the cross-section of said tail pipe tapers towards said outlet;

a combustor inner tube upstream of said tail pipe and in fluid connection with said tail pipe; and a burner upstream of said combustor inner tube and in fluid connection with said combustor inner tube;

wherein said combustor inner tube and said burner are coaxially arranged and disposed at an angle with respect to said axis of said tail pipe such that combustion gases collide with said inner wall of said tail pipe, said angle being from about 3 to about 5 degrees.

* * * * *